United States Patent [19]

Rossmann et al.

[11] Patent Number: 4,731,194

[45] Date of Patent: Mar. 15, 1988

[54] SILICA-CONTAINING ALKALINE DISPERSIONS AND THEIR USE IN CLEANING SOLID SURFACES

[75] Inventors: Christian Rossmann, Langenfeld; Horst Flüchter, Kaarst, both of Fed. Rep. of Germany

[73] Assignee: Henkel Kommanditgesellschaft auf Aktien, Duesseldorf, Fed. Rep. of Germany

[21] Appl. No.: 894,516

[22] Filed: Aug. 6, 1986

Related U.S. Application Data

[63] Continuation of Ser. No. 700,079, Feb. 11, 1985, abandoned, which is a continuation of Ser. No. 537,590, Sep. 30, 1983, abandoned.

[30] Foreign Application Priority Data

Dec. 13, 1982 [DE] Fed. Rep. of Germany ..... 3246080

[51] Int. Cl.[4] ..... C11D 7/06

[52] U.S. Cl. ..... 252/160; 252/140; 252/156; 252/174.25; 252/DIG. 14; 134/40

[58] Field of Search ..... 252/156, 140, 160, 174.25, 252/DIG. 14, 173, DIG. 13, 306, 310, 313.2, 315.6; 134/40

[56] References Cited

U.S. PATENT DOCUMENTS

| | | | |
|---|---|---|---|
| 1,744,463 | 1/1930 | Gravell | 252/156 |
| 2,992,997 | 7/1961 | Arden | 252/156 |
| 3,281,367 | 10/1966 | Jones et al. | 252/140 |
| 3,553,016 | 1/1971 | Foelsch | 252/315.6 |
| 3,574,135 | 4/1971 | Sampson et al. | 252/313.2 |
| 3,666,670 | 5/1972 | Gilbert et al. | 252/160 |
| 3,708,429 | 1/1973 | Hall | 252/160 |
| 3,823,094 | 7/1974 | Lancz | 252/90 |
| 3,997,460 | 12/1976 | Sirine et al. | 252/106 |
| 4,028,281 | 6/1977 | Millard et al. | 252/DIG. 14 |
| 4,051,055 | 9/1977 | Trinh et al. | 252/160 |
| 4,153,569 | 5/1979 | van den Brom | 252/DIG. 14 |
| 4,352,678 | 10/1982 | Jones et al. | 252/140 |
| 4,382,825 | 5/1983 | McCready | 134/40 |
| 4,390,465 | 6/1983 | Spekman, Jr. | 252/DIG. 14 |
| 4,457,856 | 7/1984 | Mitchell et al. | 252/174.25 |
| 4,556,504 | 12/1985 | Rek | 252/DIG. 14 |
| 4,597,888 | 7/1986 | King | 252/DIG. 14 |

FOREIGN PATENT DOCUMENTS

| | | |
|---|---|---|
| 0003625 | 8/1979 | European Pat. Off. . |
| 1303810 | 1/1973 | United Kingdom . |

OTHER PUBLICATIONS

Metalloberflaeche, vol. 39, No. 2, pp. 41–44, 1985, Rossmann, C.

Kirk-Othmer, Encyclopedia of Chemical Technology, 3rd Edition, vol. 20, p. 768.

*Primary Examiner*—Paul Lieberman
*Assistant Examiner*—Hoa Van Le
*Attorney, Agent, or Firm*—Ernest G. Szoke; Henry E. Millson, Jr.; Real J. Grandmaison

[57] ABSTRACT

This invention is directed to a process for cleaning solid surfaces with aqueous alkaline cleaning compositions comprising (a) stongly alkaline active-substance concentrates and (b) acidic or neutral active-substance concentrates comprising silica dispersions. Component (a) is present in an excess over component (b) sufficient to cause an alkaline medium.

8 Claims, No Drawings

SILICA-CONTAINING ALKALINE DISPERSIONS AND THEIR USE IN CLEANING SOLID SURFACES

This application in a continuation of application Ser. No. 700,079, filed Feb. 11, 1985, now abandoned, which is a continuation of application Ser. No. 537,590, filed 9/30/83, now abandoned.

FIELD OF THE INVENTION

This invention relates to silica-containing dispersions and their use in cleaning solid surfaces. More particularly, this invention relates to a process for cleaning solid surfaces with builder-containing alkaline solutions obtained by combining a strongly alkaline active-substance concentrate with an acidic or neutral active-substance concentrate, dispersions of silica being used.

BACKGROUND OF THE INVENTION

It is known that alkaline cleaning agents containing caustic soda, orthophosphates, condensed phosphates, silicates, complexing agents, wetting agents, and inhibitors can be used for cleaning solid material such as workpieces of metals or glass. These cleaning products are generally marketed as powdered mixtures and are delivered as such to a cleaning bath at intervals, the concentration of cleaning agent in the bath amounting to from about 0.1 to 20% by weight, dependent upon the particular application and the degree of soiling. If the cleaning solution is to be effective, the optimal concentration must be maintained. The optimal concentration may be determined by titration or by a conductivity measurement. The conductivity measurement for determining concentration may be carried out in conjunction with an automatic concentation adjustment.

One of the difficulties of using powdered products, particularly when they contain hygroscopic salts, is to ensure continuous uninterrupted introduction. In addition, it is precisly highly active, nonionic surfactants which are sensitive to solid caustic soda. During storage they change through oxidation to ether carboxylic acids, which impairs the effectiveness of the powdered products with respect to certain greases and, in the case of degreasing sprays, causes troublesome foaming.

It is also known that liquid cleaning agents showing an alkaline reaction can be used for the purpose in question, having been obtained and regenerated by combining a strongly alkaline active-substance concentrate with an acidic or neutral active-substance concentrate. However, it has not not been possible in this way to produce silicate-containing cleaners Furthermore, products having a high active-substance content require a very high concentration of hydrotropic substance and/or of potassium salts having a low active-substance content.

OBJECTS OF THE INVENTION

It is an object of the invention to provide silica-containing dispersions useful in cleaning solid surfaces.

It is also an object of the invention to provide a process for cleaning solid surfaces with builder-containing alkaline solutions obtained by combining a strongly alkaline active-substance concentrate with an acidic or neutral active-substance concentrate containing a silica dispersion.

These and other objects of the invention will become more apparent in the discussion below.

DETAILED DESCRIPTION OF THE INVENTION

It has now been found that most of the disadvantages encountered hitherto can be avoided by using the process described hereinafter. According to the process, solid surfaces are cleaned with builder-containing alkaline solutions obtained by combining a strongly alkaline active-substance concentrate with an acidic or neutral active-substance concentrate, the alkaline active-substance concentrate being used in excess to obtain an alkaline medium, the solutions being characterized in that a dispersion of silica is used as the acidic or neutral active-substance concenrate. The concentration of silica in the dispersion should be in the range of from about 5 to 40% by weight, preferably in the range of from about 10 to 30% by weight, based upon the total weight of the silica dispersion.

The silica dispersion may be prepared in known manner from pyrogenic and/or precipitated silica. In cases where silica dispersions of relatively high concentrations are used, it is advantageous to add stabilizers, such as vegetable gum, polyvinyl pyrrolidone, or polyacrylic acid, in small quantities, preferably in quantities of less than 5% by weight, based upon the total weight of the silica dispersions. To avoid bacterial infestation, preservatives may be added to neutral silica dispersions.

To obtain a good cleaning effect, it is advantagous for the silica dispersion to contain other ingredients. For example, phosphoric acid and alkali metal polyphosphates neutralized to pH values from about 6 to 9 are particularly suitable for this purpose. These componds may be added in quantities of about 0.001 to 40% by weight, based on the total weight of the silica dispersion. Some of the phosphoric acid, i.e., up to about 50%, may be replaced by sulfuric acid.

Additions of anionic, nonionic, and/or amphoteric surfactants are also suitable for this purpose. In this case, it is possible to use such comounds as alkyl benzene sulfonates, alkyl sulfonates, fatty alcohol sulfates, adducts of etylene and/or propylene oxide onto fatty alcohols, fatty amines, and alkyl phenols, and also surface-active ethylene oxide/propylene oxide block polymers. The carbon chain lengths of the alkyl radicals in these compounds are in the range from 12 to 20, with the exception of the alkyl phenols where the carbon chain lengths are in the range from about 6 to 18. Other suitable amphoteric surfactants include such compounds as alkyl dimethyl ammonium betaines ($C_{12}$–$C_{18}$-alkyl radical). The quantities of wetting agents advantageously amount to from about 0.5 to 10% by weight, based upon the total weight of the silica dispersion.

Finally, the silica dispersion may contain complexing agents, particularly in the form of acids, such as nitrilotriacetic acid, ethylenediamine-tetraacetic acid, gluconic acid, and/or citric acid, preferably phosphonic acids or phosphonocarboxylic acids, such as hydroxyethane-1,1-diphosphonic acid, aminotrimethylene phosphonic acid, and 2-phosphono-1,2,4-butane tricarboxylic acid. Optionally, such complexing agents may also be added to the alkaline component.

The alkaline component consists essentially of sodium hydroxide or potassium hydroxide. In addition, it is possible to use constituents of the type which are not compatible with the substances of the silica dispersion, such as, for example, lignin sulfonates.

In the context of the invention, the expression "excess" is to be understood to mean a quantity of sodium hydroxide or potassium hydroxide which is sufficient to give the cleaning agent a pH-value above about 11, preferably above about 12. The cleaning agent is formed by combining the alkaline active-substance concentrate with the silica dispersion.

The procedure described above has the advantage that highly concentrated active-substance containing cleaning agents can be produced without an unnecessary concentration of hydrotropic substances and/or potassium salts being required.

The dispersions may be prepared by introducing the silica with stirring into an acidic or neutral solution optionally containing a stabilizer and wetting agents.

In the preparation of cleaning agent solutions using two active-substance components, it is possible to make up a cleaning solution differing in its alkalinity according to the degree of soiling of the material to be treated by using a large or relatively small proportion of the alkaline component. Since the cleaning solution always shows an alkaline reaction, the concentration of the solution may be determined through the conductivity of the hydroxyl ions. The othe active-substance components are then added in a ratio commensurate to the alkaline component. This ensures continuous, problem-free introduction of the cleaning agent concentrates. To make the concentrates more visible, they may be colored with indicators. With regard to other conditions, the process is carried out at the temperatures normally used for cleaning and degreasing, i.e., at temperatures in the range of from about 20° to 100° C., preferably at temperatures in the range of from about 50° to 80° C.

The following examples are intended to illustrate the invention and should not be construed as limiting the invention thereto. The percentages mentioned below are percentages by weight, based upon the total weight of the silica dispersion.

EXAMPLES

EXAMPLE 1

The preparation of a 50 gm/l degreasing solution having an $SiO_2$ to $Na_2O$ ratio of 0.5:1 required 58 gm/l of the following dispersion:

18% of the $SiO_2$ (precipitated silica),
2% of aminotrimethylene phosphonic acid (60%),
10% of the adduct of 10 mols of ethylene oxide onto nonyl phenol,
10% of orthophosphoric acid (75%), and
60% of water, and
72 gm/l of a 50% sodium hdroxide solution.

EXAMPLE 2

The preparation of a 50 gm/l degreasing solution having an $SiO_2$ to $Na_2O$ ratio of 1:1 required 66 gm/l of the following dispersion:

20% of pyrogenic silica,
20% of orthophosphoric acid (75%),
54% of water,
4% of the adduct of 12 mols of ethylene oxide onto fatty amine, and
2% of the adduct of 30 mols of ethylene oxide and 60 mols of propylene oxide unto ethylenediamine, and
62 gm/l of a 50% sodium hydroxide solution.

EXAMPLE 3

The preparation of a 40 gm/l degreasing solution having an $SiO_2$ to $Na_2O$ ratio of 0.75:1 required 48 gm/l of the following dispersion:

20% of silica,
20% of orthophosphoric acid (75%),
3% of the adduct of 11 mols of ethylene oxide onto nonyl phenol,
3% of alkylbenzenesulfonic acid ($C_{12}$–alkyl radical),
0.1% of vegetable gum, and
53.9% of water, and
53 gm/l of a 50% sodium hydroxide solution.

EXAMPLE 4

The preparation of a 40 gm/l degreasing solution having an $SiO_2$ to $Na_2O$ ratio of 0.3:1 required 32 gm/l of the following dispersion:

22% of silica,
6% of orthophosphoric acid (75%),
8% of amphoteric wetting agent (alkyl dimethyl ammonium betaine, $C_{12}$–$C_{18}$–alkyl radical), and
64% of water, and
64 gm/l of a 50% sodium hydroxide solution.

EXAMPLE 5

The preparation of an 80 gm/l degreasing solution having an $SiO_2$ to $Na_2O$ ratio of 0.15:1 required 36 gm/l of the following dispersion:

24% of pyrogenic silica, and
76% of water, and
147 gm/l of a 50% sodium hydroxide solution.

EXAMPLE 6

The preparation of a 60 gm/l degreasing solution having an $SiO_2$ to $Na_2O$ ratio of 0.8:1 required 69 gm/l of the following dispersion (adjusted to pH 7):

24% of silica (precipitated silica),
3% of fatty alcohol ether sulfate,
20% of sodium tripolyphosphate,
52% of water, and
1% of perservative (5-bromo-5-nitro-1,3-dioxane), and
54 gm/l of a 50% sodium hydroxide solution.

EXAMPLE 7

The preparation of a 50 gm/l degreasing solution having an $SiO_2$ to $Na_2O$ ratio of 0.4:1 required 59 gm/l of the following dispersion:

18% of silica,
4% of othophosphoric acid (75%),
3% of the adduct of 14 mols of ethylene oxide onto $C_{12}$–$C_{18}$–fatty alcohol,
2% of alkylbenzenesulfonic acid ($C_{12}$ alkyl radical),
2% of polyvinyl pyrrolidone, and
71% of water, and
74 gm/l of a 50% sodium hydroxide solution.

EXAMPLE 8

The preparation of 100 gm/l degreasing solution having an $SiO_2$ to $Na_2O$ ratio of 0.2:1 required 73 gm/l of the following dispersion:

15% of silica,
20% of gluconic acid (50%),
10% of sulfuric acid (98%),
3% of the adduct of 5 mols of ehtylene oxide and 4 mols of propylene oxide onto $C_9$–$C_{13}$–alkanol, and
52% of water, and
156 gm/l of a 50% sodium hydroxide solution.

In the examples above, and as is in accordance with the invention, each quantity of silica dispersion or sodium and/or potassium hydroxide solution is prepared separately. Then, the respective quantities of silica dispersion and sodium and/or potassium hydroxide solution are added separately to a base aqueous solution, preferably water or water with conventional additives. In this way, potential solubility difficulties are overcome.

The weight ratios of the silica dispersions and the sodium and/or hydroxide solutions to the final cleaning compositions can vary over a wide range. The ratio of the silica dispersion (gm/l) to the final cleaning solution (gm/l) can range from about 0.2:1 to 2:1, preferably from about 0.25:1 to 1.5:1 and most preferably from about 0.3:1 to 1.4:1. The ratio of the sodium and/or potassium hydroxide solution (gm/l) to the final cleaning solution (gm/l) can range from about 0.5:1 to 3:1, preferably from about 0.8:1 to 2.5:1 and most preferably from about 0.75:1 to 2:1.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. An aqueous two-component composition useful for cleaning and degreasing hard surfaces comprising, as one component, (a) a strongly alkaline active-substance concentrate consisting of about 50% by weight of sodium hydroxide or potassium hydroxide and, as the other component, (b) an acidic or neutral active-substance concentrate consisting of a silica dispersion containing from about 5 to 40% by weight, based on the total weight of the active-substance concentrate (b), of silica selected from the group consisting of pyrogenic silica, precipitated silica and mixtures thereof, component (a) being present in an excess sufficient to cause an alkaline medium having a pH above about 11 when components (a) and (b) are combined prior to use.

2. The cleaning composition of claim 1 wherein component (b) is present in an amount sufficient to cause an alkaline medium having a pH above about 12 when components (a) and (b) are combined.

3. The cleaning composition of claim 1 wherein the weight ratio of component (b) to component (a) when combined is from about 0.2:1 to 2:1.

4. The cleaning composition of claim 1 wherein the weight ratio of component (b) to component (a) when combined is from about 0.25:1 to 1.5:1.

5. The cleaning composition of claim 1 wherein the weight ratio of component (a) to the combination of component (a) and component (b) in grams per liter is from about 0.5:1 to 3:1.

6. The cleaning composition of claim 1 wherein the weight ratio of component (a) to the combination of component (a) and component (b) in grams per liter is from about 0.8:1 to 2.5:1.

7. The cleaning composition of claim 1 wherein the weight ratio of component (a) to the combination of component (a) and component (b) in grams per liter is from about 0.75:1 to 2:1.

8. An aqueous two-component composition useful for cleaning and degreasing hard surfaces consisting of as one component, (a) a strongly alkaline aqueous concentrate of about 50% by weight of sodium hydroxide or potassium hydroxide, and, as the other component, (b) an acidic or neutral activesubstance aqueous concentrate consisting of a silica dispersion containing from about 10% to about 30% by weight of silica selected from the group consisting of pyrogenic silica, precipitated silica and mixtures thereof, from 0 to about 5% by weight of a stabilizer for silca dispersions, from about 0.001% to about 40% by weight of a phosphorous compound selected from the group consisting of phosphoric acid and alkali metal polyphosphates neutralized to a pH of from about 6 to about 9, where up to about 50% of said phosphoric acid can be replaced by sulfuric acid, and from about 0.5% to about 10% by weight of a surfactant selected from the group consisting of anionic surfactants, nonionic surfactants, amphoteric surfactants and mixtures thereof, all weights based on the total weight of the active-substance concentrate (b), component (a) being present in an amount sufficient to cause an alkaline medium having a pH above about 12 when components (a) and (b) are combined prior to use.

* * * * *